US007260236B2

(12) United States Patent
De Roo et al.

(10) Patent No.: US 7,260,236 B2
(45) Date of Patent: Aug. 21, 2007

(54) WIND NOISE SUPPRESSION IN DIRECTIONAL MICROPHONES

(75) Inventors: Dion Ivo De Roo, Leidschendam (NL); Aart van Halteren, Hobrede (NL); Bastiaan Broekhuijsen, Purmerend (NL)

(73) Assignee: Sonionmicrotronic Nederland B.V., Amsterdam (NL)

( * ) Notice: Subject to any disclaimer, the term of this patent is extended or adjusted under 35 U.S.C. 154(b) by 1062 days.

(21) Appl. No.: 10/042,860

(22) Filed: Jan. 9, 2002

(65) Prior Publication Data

US 2002/0094101 A1 Jul. 18, 2002

Related U.S. Application Data

(60) Provisional application No. 60/261,493, filed on Jan. 12, 2001.

(51) Int. Cl.
*H04R 9/08* (2006.01)

(52) U.S. Cl. ..... 381/356; 381/359

(58) Field of Classification Search ..... 381/170, 381/171, 337, 338, 356, 357, 358, 359, 369
See application file for complete search history.

(56) References Cited

U.S. PATENT DOCUMENTS 3,836,732 A * 9/1974 Johanson et al. ..... 381/313
5,878,147 A 3/1999 Killion et al. ..... 381/313
6,075,869 A 6/2000 Killion et al. ..... 381/313
6,134,334 A 10/2000 Killion et al. ..... 381/356
6,151,399 A * 11/2000 Killion et al. ..... 381/313
6,285,771 B1 * 9/2001 Killion et al. ..... 381/313

FOREIGN PATENT DOCUMENTS

WO 00/38477 6/2000

OTHER PUBLICATIONS

Acoustical Society of America 136th Meeting Lay Language Papers; Electronic Removal of Outdoor Microphone Wind Noise; Oct. 12-13, 1998 (5 pages).

* cited by examiner

*Primary Examiner*—Sinh Tran
*Assistant Examiner*—Brian Ensey
(74) *Attorney, Agent, or Firm*—Jenkens & Gilchrist

(57) ABSTRACT

A directional microphone includes a housing, a diaphragm dividing the housing into a front volume and a back volume, electronics for detecting signals corresponding to movements of the diaphragm, and front and back inlets for the front and back volumes, respectively. To obtain additional low frequency roll-off in the directional microphone, the directional microphone includes an elongated acoustical conduit connecting the front volume and the back volume. The acoustical conduit may be external or internal to the housing.

47 Claims, 15 Drawing Sheets

WIND NOISE SUPPRESSION IN DIRECTIONAL MICROPHONES

RELATED APPLICATION

This application claims the benefit of priority to U.S. Provisional Patent Application Ser. No. 60/261,493, filed Jan. 12, 2001.

FIELD OF THE INVENTION

The present invention relates to directional microphones and, specifically, to a directional microphone employing tubes or channels connecting the front and back volumes to reduce the undesirable effects of wind noise.

BACKGROUND OF THE INVENTION

Directional microphones have openings to both the front and back volumes and provide an output corresponding to the subtraction of two time delayed signals (i.e., the principle of directivity), resulting in a 6 dB/octave low frequency roll-off in their frequency response curves. Compared to pressure or omnidirectional microphones, the output for directional microphones is attenuated by the effective subtraction of the two input signals, while the noise is magnified by the presence of an essentially infinite rear or back volume. Therefore, the signal-to-noise ratio of directional microphones is much poorer at low frequencies, which makes them more sensitive to low frequency noise sources, like wind noise. A brief explanation of the properties of wind provides a better understanding of the problems that wind creates in directional microphones.

Air molecules are always in motion, but usually in a random direction. During a wind, the air molecules have an appreciable bias towards one direction. When an obstacle is met, the air is redirected. Sometimes the velocity of the air is decreased when an obstacle is met. For some obstacles, however, the velocity of the air increases and the air is diverted. The diverted air may produce a vortex where the air swirls in a circular motion. This vortex can have very high wind velocity and pressure. The sound produced by this vortex is usually of low frequency and acts as though it were coming from a point source in the vicinity of the vortex. For a low frequency point source, the phase difference at two loci close to the sound origin will be very small. The amplitude difference, however, can be very large.

Now consider the effect of a vortex caused by the presence of a directional microphone. The output of a directional microphone is related to the displacement of the diaphragm, which reacts to a difference in sound pressure between the front and back volumes. As said above, the turbulence of the wind causes a source of noise that is essentially a point source of low frequency sound at the center of the vortex. The signals received at both sound inlets will then be appreciably in phase, because the frequency is low and, therefore, the wavelength much greater than the spacing between the sound inlets. If the distance between the sound inlets is approximately the same distance as the distance from the closer inlet to the vortex, however, the further inlet will receive a sound 6 dB lower in level than the one arriving at the closer inlet. It is the pressure difference that causes the problem and results in a diaphragm displacement in the direction of the lowest pressure which, consequently, results in a relatively high microphone output. In effect, the directional microphone becomes a close-talking microphone for the wind turbulence, yet remains a directional microphone for plane wave or distant sounds. The problem is accentuated for wind noise since the amplitude of the sound from the wind can be very high, which may deafen the desired sounds, such as those from speech.

The current solution practiced in many directional hearing aids is to use an open celled foam cap or a protective mechanical flat screen or grid that is applied mostly in the faceplate of the hearing aid to smooth the turbulence. Although this solution appears to be helpful in practice, it has a great impact on the design of the faceplate or shell of a hearing aid since it may require more faceplate area, and/or additional parts, and/or additional production steps for assembly. These mechanical solutions do not, however, entirely solve the problem since the wind still produces an annoying sound to the wearer of the hearing aid. Further, the use of an electronic high pass filter may not be effective in situations where high SPL noise sources cause overload in the input stage of the microphone amplifier. Therefore, the low frequency noise signals should be attenuated before they cause distortion products in the high frequency spectrum. As such, there is still a strong desire in the market to reduce the effects of wind noise in directional microphones.

SUMMARY OF THE INVENTION

To solve the aforementioned problems, a wind noise suppression conduit is placed in the directional microphone to join the front and back volumes. The conduit may extend across the diaphragm internal to the housing of the microphone. Alternatively, the conduit may reside external to the housing of the microphone, connecting the front and back inlets leading to the front and back volumes, respectively, or the conduit may be formed by molding a mounting plate which connects the front and back volumes when positioned against the housing of the microphone.

The wind noise suppression conduit presents an acoustical mass (i.e., related to acoustical inertance, and the acoustic equivalent of an electrical inductance) that, together with the acoustical resistances of the mechanical screens in the sound inlets, causes a low frequency roll-off of 6 dB/octave. When added to the inherent frequency roll-off of a directional microphone that is typically 6 dB/octave, the overall microphone has a low frequency roll-off at 12 dB/octave for its frequency response. Accordingly, wind noise is suppressed such that the wearer of the hearing aid receives a reduced output of wind noise that provides much less of a tendency for the microphone to overload and also much less of a likelihood for low frequency masking by the wind noise of the higher frequencies of the speech signal.

BRIEF DESCRIPTION OF THE DRAWINGS

The foregoing and other advantages of the invention will become apparent upon reading the following detailed description and upon reference to the drawings.

Figure 1A:
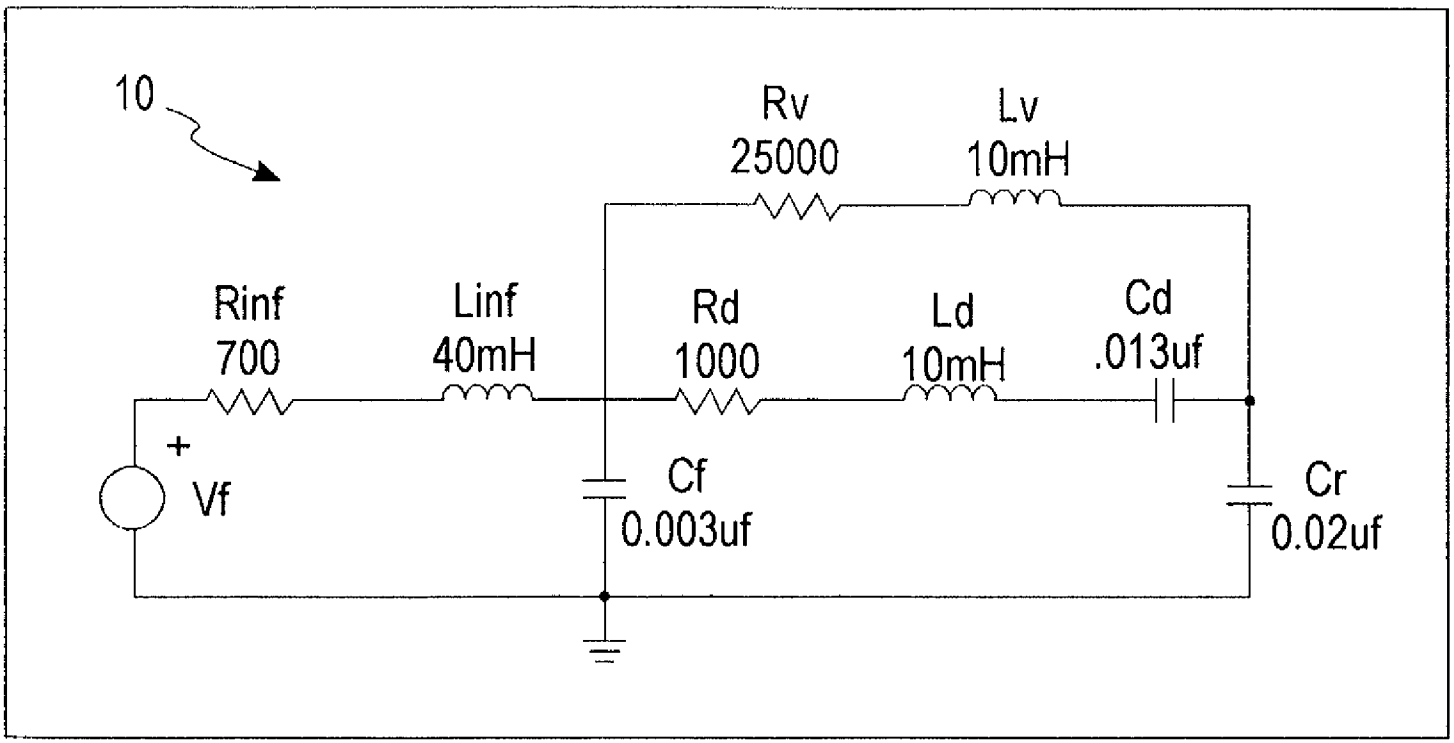
FIG. 1A is an exemplary electrical schematic analogizing the acoustical network of a standard pressure or omni-directional microphone having a vent in the diaphragm.

While the invention is susceptible to various modifications and alternative forms, specific embodiments have been shown by way of example in the drawings and will be described in detail herein. It should be understood, however, that the invention is not intended to be limited to the particular forms disclosed. Rather, the invention is to cover all modifications, equivalents, and alternatives falling within the spirit and scope of the invention as defined by the appended claims.

DESCRIPTION OF ILLUSTRATIVE EMBODIMENTS

To appreciate the present invention, reference is made to the well-known analogy between acoustical networks and electrical circuits. In this analogy, acoustical compliance is analogous to electrical capacitance, acoustical inertance (or mass) is analogous to electrical inductance, and acoustical resistance is analogous to electrical resistance. Several of the acoustical networks will be described as electrical networks with values placed on the components of the networks. It should be understood that the application of the present invention is not limited to only those values listed, but can be applied to directional microphones having various values for the acoustical resistances, acoustical compliances, and acoustical inertances of the components in their acoustical networks.

FIG. 1A illustrates an electrical schematic that is analogous to the acoustical network 10 for a standard pressure microphone. $R_{inf}$ and $L_{inf}$ are the acoustical resistance of the input screen placed in a front inlet and the acoustical inertance of the air in the inlet, respectively, of the standard pressure microphone.

$R_d$, $L_d$, and $C_d$ are the acoustical resistance, acoustical inertance, and acoustical compliance of the diaphragm within the microphone. The resistance, $R_d$, is the resistance to the sound wave impinging on the diaphragm. The inertance, $L_d$, relates to the mass of the diaphragm. The compliance, $C_d$, relates to the spring effect of the diaphragm.

$R_v$ and $L_v$ are the acoustical resistance and inertance, respectively, of the vent in the diaphragm leading from the front volume to the back volume. The vent is placed in the diaphragm to equalize the pressure between the front and back volumes.

$C_f$ and $C_r$ are the compliances of the front volume and the back (rear) volume, respectively. They represent the ability of the air to be compressed and expanded under pressure in the front and back volumes. $V_f$ represents the pressure from a sound source that would be entering the front volume.

The values placed adjacent to each of these acoustical components in the network 10 are representative of typical values for a Model 100-Series microphone from Microtronic, the assignee of the present application.

Figure 1B:
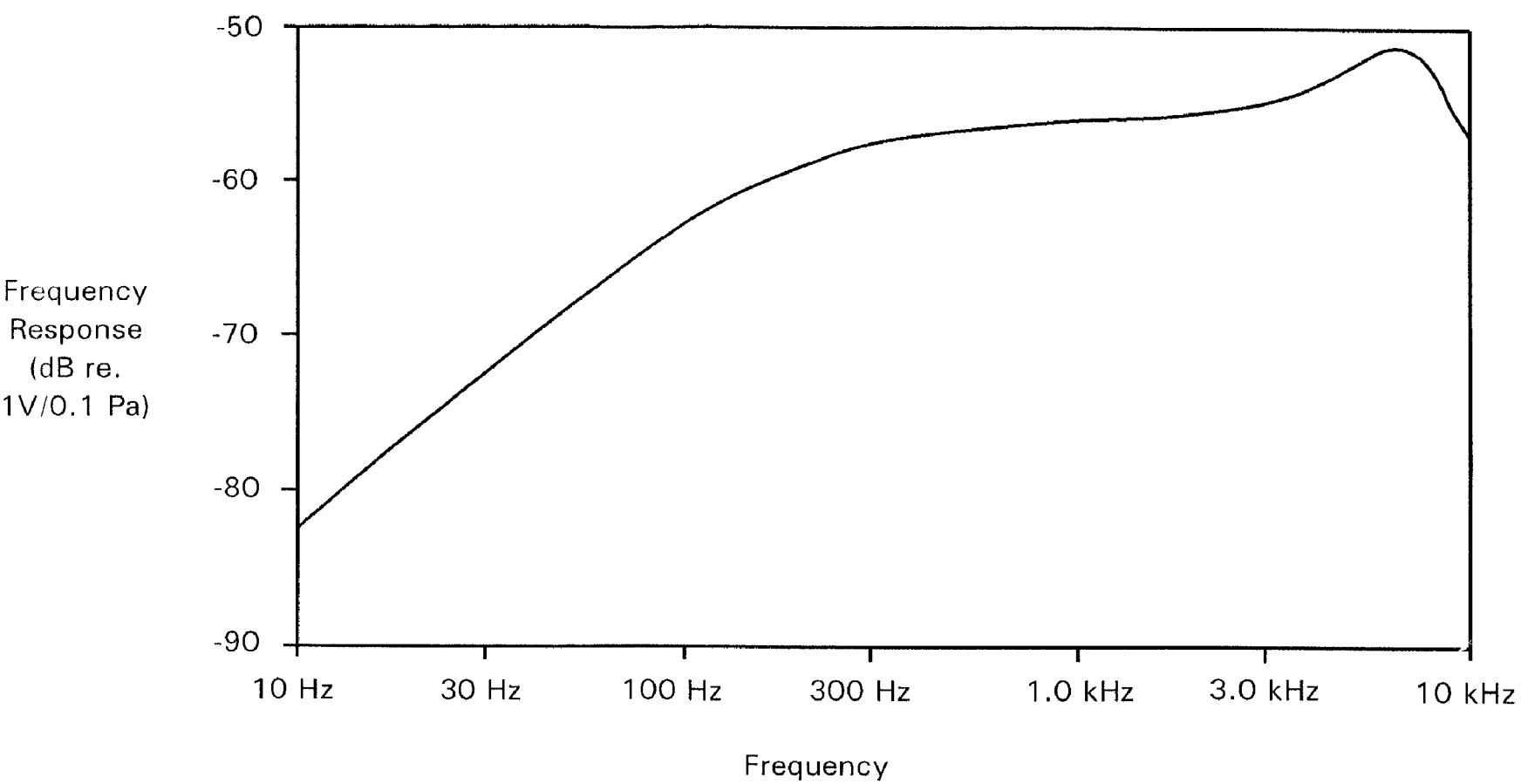
FIG. 1B is a frequency response curve for the standard pressure or omni-directional microphone of FIG. 1A.

FIG. 1B is a frequency response curve of the microphone defined by the acoustical network 10 in FIG. 1A. For low frequencies, the slope of the line is about 6 dB per octave. Thus, the microphone having the acoustical network 10 of FIG. 1A has a 6 dB per octave roll-off for low frequencies.

Figure 2A:
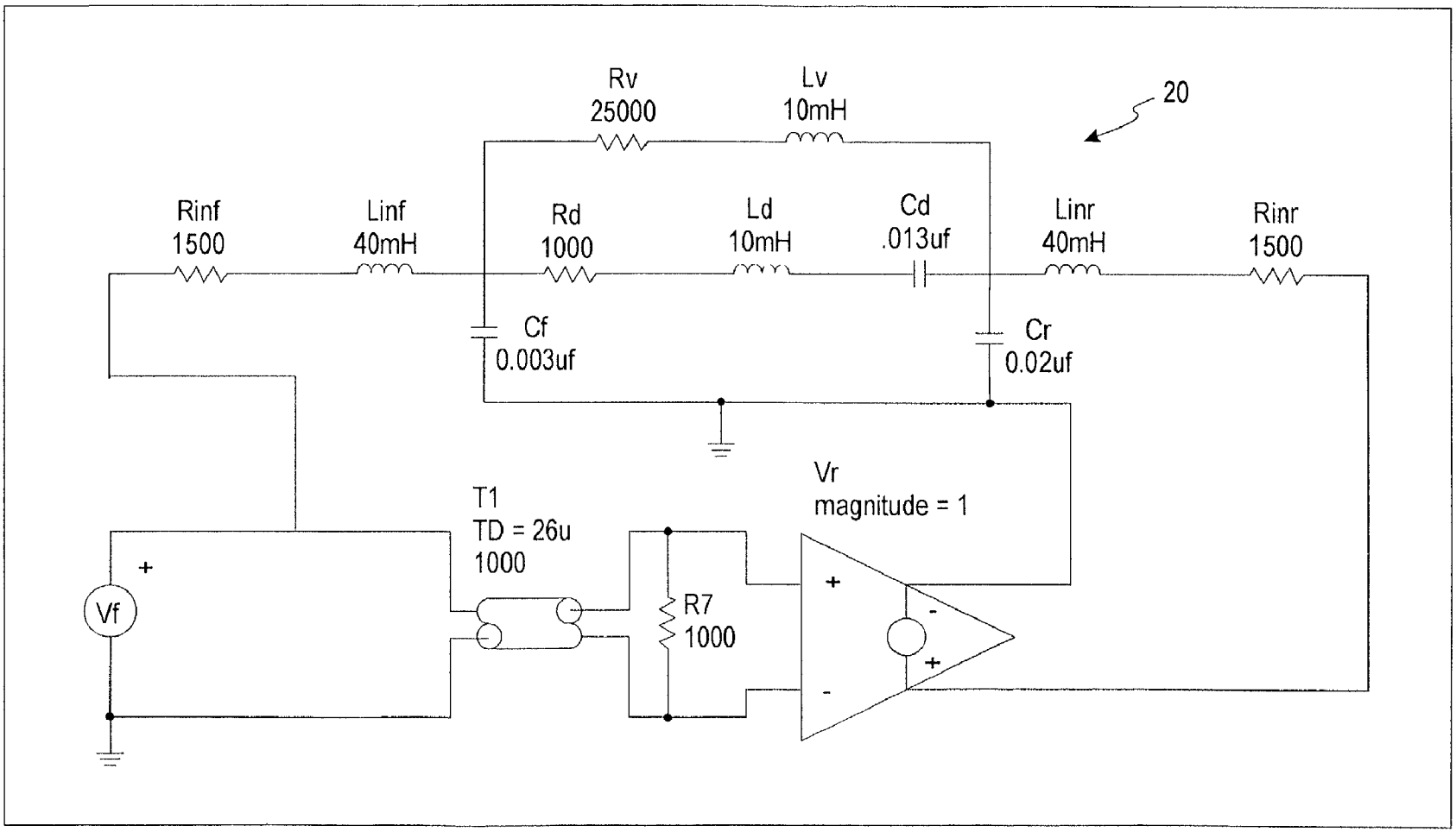
FIG. 2A is an exemplary electrical schematic analogizing the acoustical network of a directional microphone having a vent in the diaphragm.

FIG. 2A illustrates an electrical schematic that is analogous to the acoustical network 20 for a directional microphone that includes a vent in the diaphragm. Directional microphones are not usually constructed with a vent in the diaphragm, since there is no need for a vent to equalize the pressure due to the front and back volumes being opened to the ambient environment. However, the directional microphone represented by the acoustical network 20 includes a vent in the diaphragm to illustrate its effects. In one embodiment, the vent is a tube having a very small diameter (e.g., 45 to 60 microns) and a very short length that is the thickness of the diaphragm. Thus, the vent is a highly resistive component but with a low inductance (i.e., inertance).

Figure 2B:
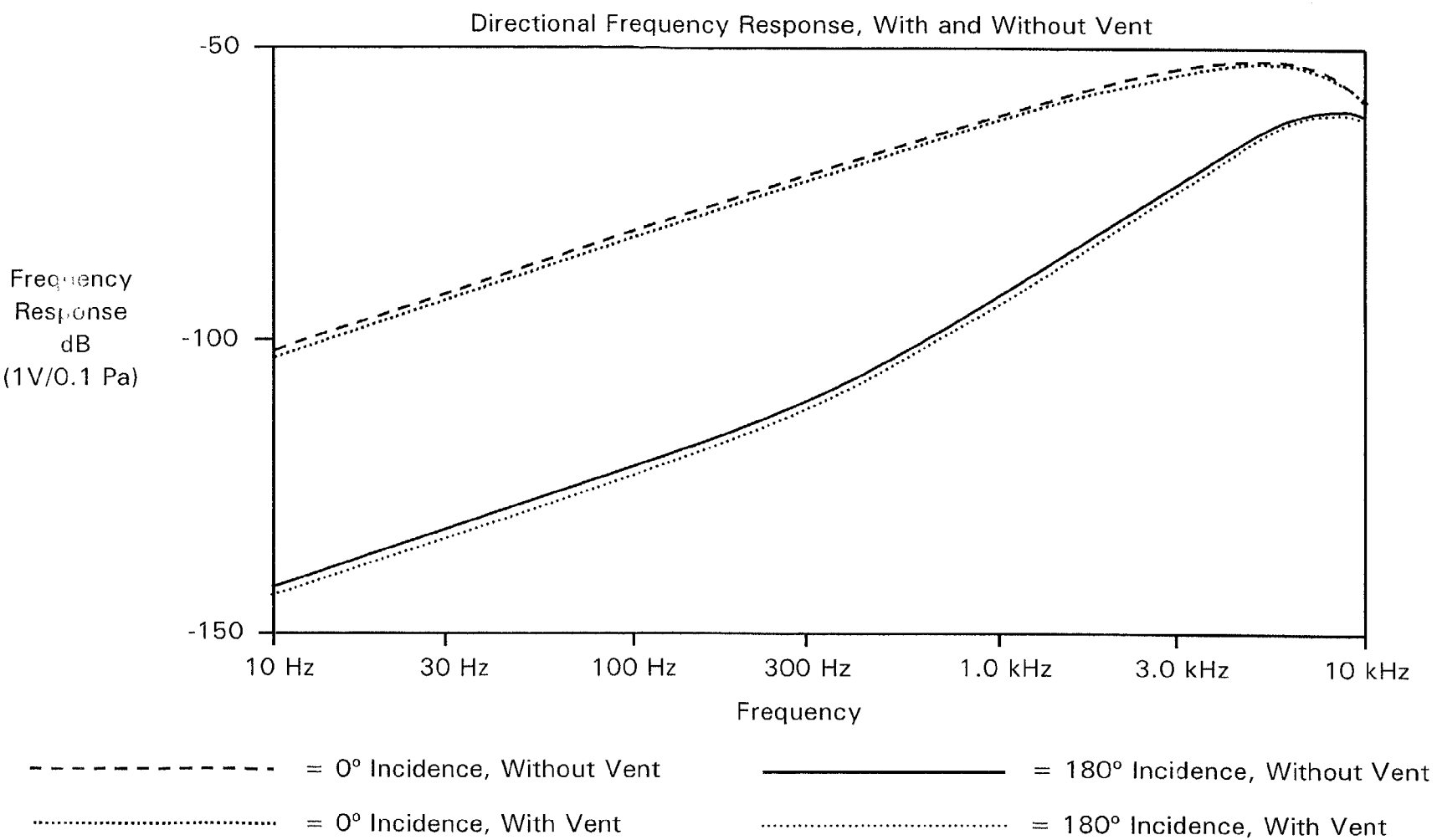
FIG. 2B is a frequency response curve for the directional microphone of FIG. 2A and a directional microphone that lacks a vent in the diaphragm (i.e., a standard directional microphone).

All of the reference components in the acoustical network 20 shown in FIG. 2B are the same as in FIG. 1A, except that the $R_{inr}$ and $L_{inr}$ are the acoustical resistance of the screen in the back (rear) inlet and the inertance of the rear inlet, respectively, of the directional microphone. The primary purpose of the screens in the front and rear inlets is to provide a net internal time delay (i.e., a phase shift) to sounds entering their respective volumes. The internal time delay of a directional microphone is set such that a desired polar directivity pattern is obtained. On the other hand, the primary purpose of the screens in omni-directional microphones and pressure microphones is to dampen the peak in the frequency response.

Further, a time delay circuit, which includes $T_1$, $R_7$ ($R_7$ is the terminating impedance and is set equal to the characteristic impedance of the delay line T1 in order to simulate a uni-directional plane wave), and the amplifier having Vr as an output leading to the rear inlet, represents the time lag between the sound wave entering the front and rear inlets. Thus, an external time delay, TD, of 26 microseconds is used in this directional microphone model and is a function of the distance between the front and back inlets. Because the magnitude of $V_r$ and $V_f$ are the same, FIG. 2A is modeling a plane wave of conversational speech where there is no pressure imbalance. In other words, the lower portion of the circuit in FIG. 2A is the modeling of the sound inputs ($V_r$ and $V_f$) that are received in the front and rear inlets of a directional microphone having this type of acoustical network 20.

FIG. 2B illustrates the frequency response curves for the acoustical network 20 in FIG. 2A, with and without the vent (i.e., with and without the upper branch having the acoustical resistance $R_v$ and inertance $L_v$). As can be seen, sound waves having angles of incidence to the inlets of 0° (directly impinging the inlets) and 180° result in no change in the curve shape with the vent and without the vent. The reason is as follows. The sensitivity of a microphone is related to the acoustic volume velocity at the diaphragm. This is represented in the schematic of FIG. 2A by the current flowing through capacitor $C_d$. The diaphragm vent, with its resistance $R_v$ and impedance $L_v$, causes a high impedance bypass path that, as a result, somewhat reduces the current through $C_d$. The effect is a resistive voltage divider of the vent, in series with the total screen resistors, $R_{inf}$ and $R_{inr}$. Since the vent resistance is normally much larger than the mechanical screens in the back and front inlets, the attenuation due to the vent is often negligible. Accordingly, a simple vent in the diaphragm of a directional microphone will not result in a decrease in the roll-off at low frequencies.

Figure 3A:
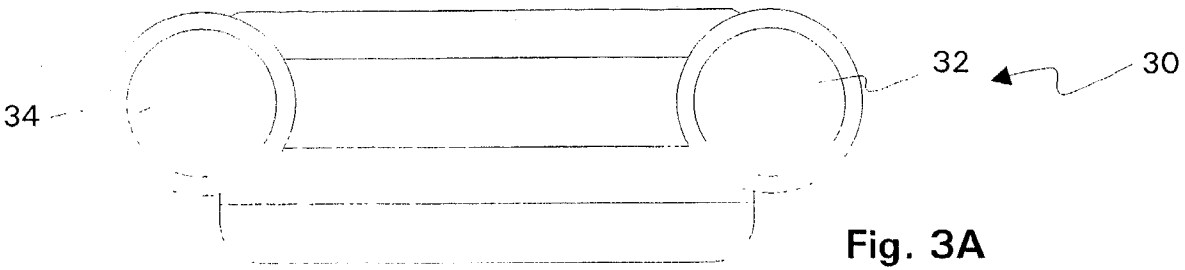
FIGS. 3A–3C are an embodiment of the present invention employing an external wind noise suppression channel.
Figure 3B:
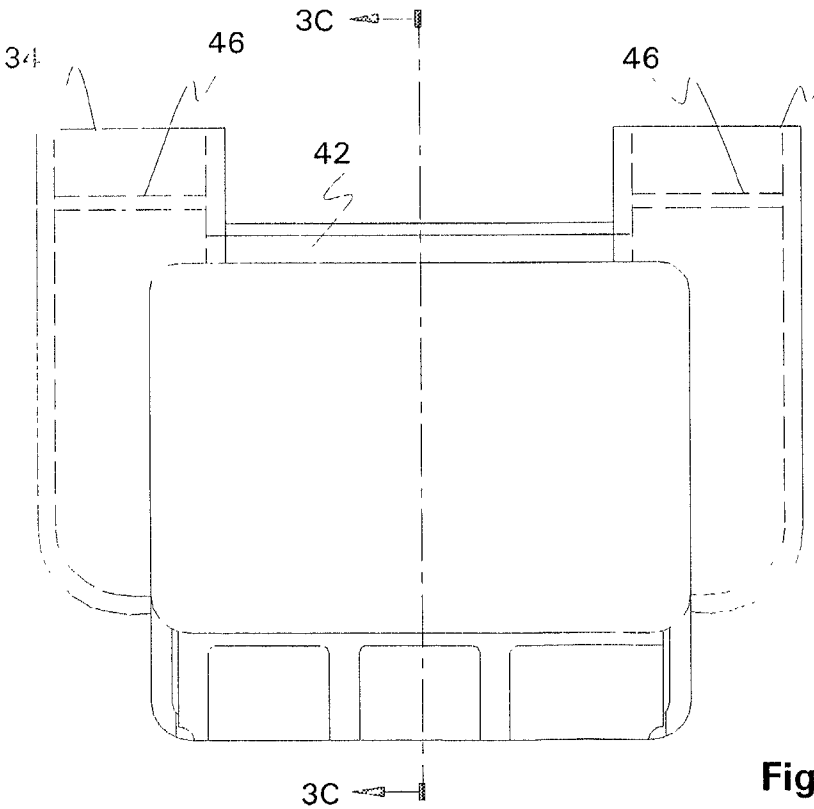
Figure 3C:
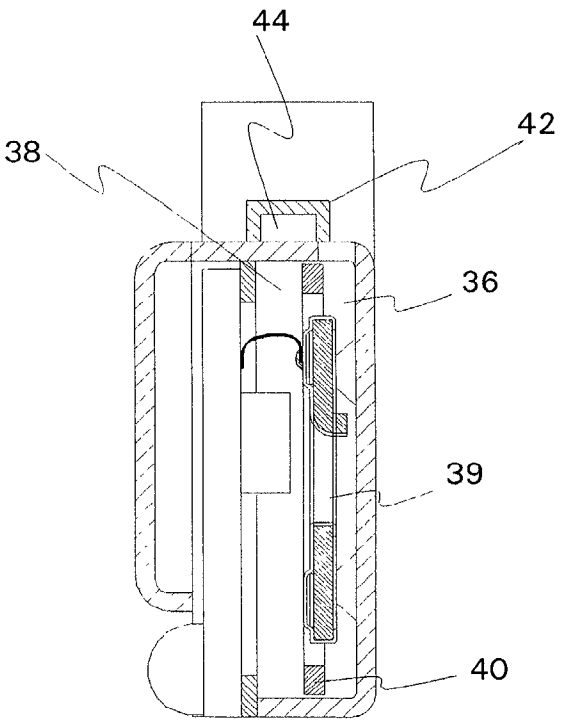

FIGS. 3A–3C illustrate several views of a directional microphone employing an external wind noise suppression channel according to one embodiment of the present invention. A directional microphone 30 includes a front inlet 32 and a back inlet 34 that lead into a housing that includes a front volume 36 and a back volume 38, respectively. A diaphragm 39 divides the front volume 36 from the back volume 38. The diaphragm 39 is supported within the directional microphone 30 by a support structure 40 attached to the inside of the housing.

An external C-shaped channel 42 extends between the front inlet 32 and the back inlet 34. The channel 42 has an internal opening 44 that acoustically connects the front inlet 32 and the back inlet 34. The rectangular internal opening 44 is defined on three sides by the C-shaped channel 42 and one side by the external surface of the housing 42. The intersections of the internal opening 44 and the inlets 32 and 34 are downstream from the screens 46 that are often placed within the inlets 32 and 34 to assist in developing the phase shift. It is these screens 46 that represent the $R_{inf}$ and $R_{inr}$ in the previous schematic of FIG. 2A.

Figure 4A:
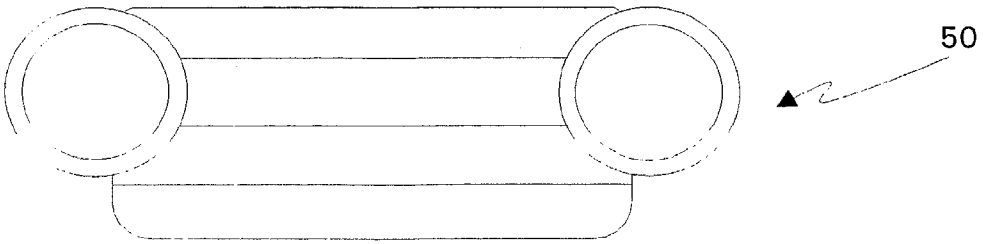
FIGS. 4A–4C are another embodiment of the present invention employing an external wind noise suppression tube.
Figure 4B:
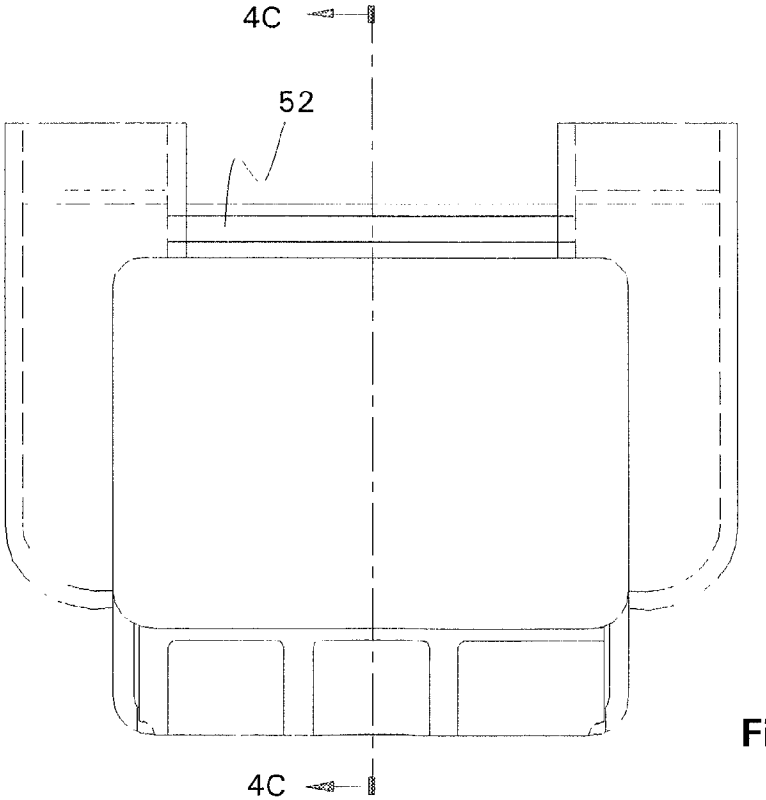
Figure 4C:
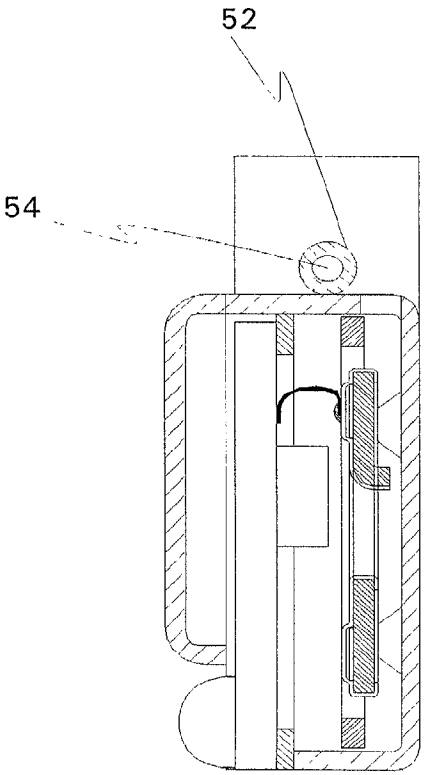

FIGS. 4A–4C illustrate a a directional microphone 50 according to another embodiment of the present invention. The directional microphone 50 includes a cylindrical tube 52 having an internal circular opening 54 connects the front inlet 32 and the back inlet 34. The theory of operation between the directional microphone 30 of FIGS. 3A–3C and the directional microphone 50 of FIGS. 4A–4C is the same, although the dimensions and shapes of the internal openings 44 and 54 are slightly different.

The lengths of the channel 42 and the tube 52 (i.e., the acoustical conduits) are usually in the range of about 1 mm to about 6 mm, and the openings 44 and 45 have dimensions (diameters) that range from about 0.05 mm to about 0.5 mm. Of course, the front inlet 32 and the back inlet 34 could be moved relative to each other to accommodate a certain length that produces a desirable effect in the performance of the microphone.

Further, the channel 42 or tube 52 can be formed as an integral part of the front and back inlets 32 and 34. Thus, the assembly would then be a cap-like structure that fits onto the microphone. Such a structure could be molded of a plastic placed over the microphone housing and sealed along its periphery. As yet a further embodiment, the channel or tube could be an integral structure formed along an exterior wall of the housing between the inlets.

Figure 5B:
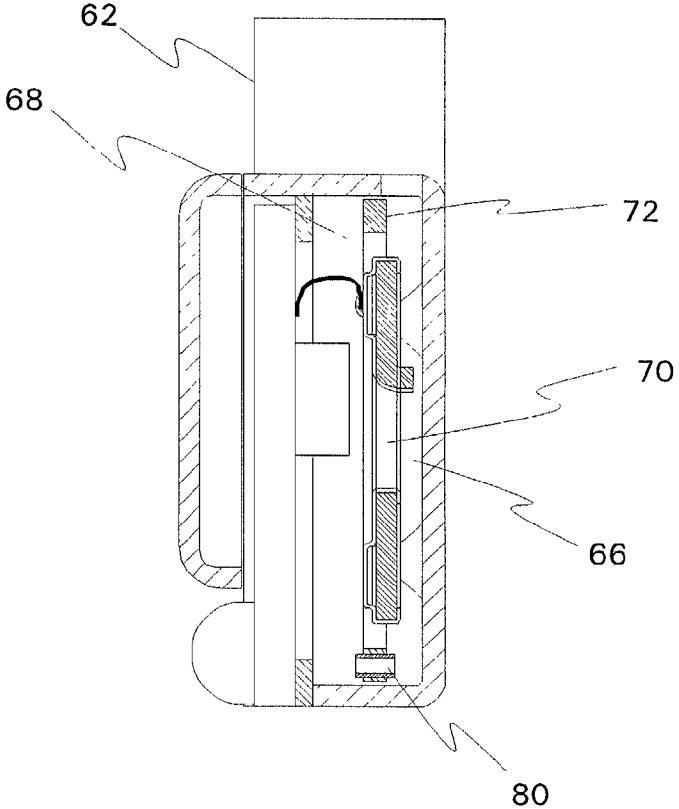
FIGS. 5A–5B are yet another embodiment of the present invention employing an internal wind noise suppression tube.
Figure 5A:
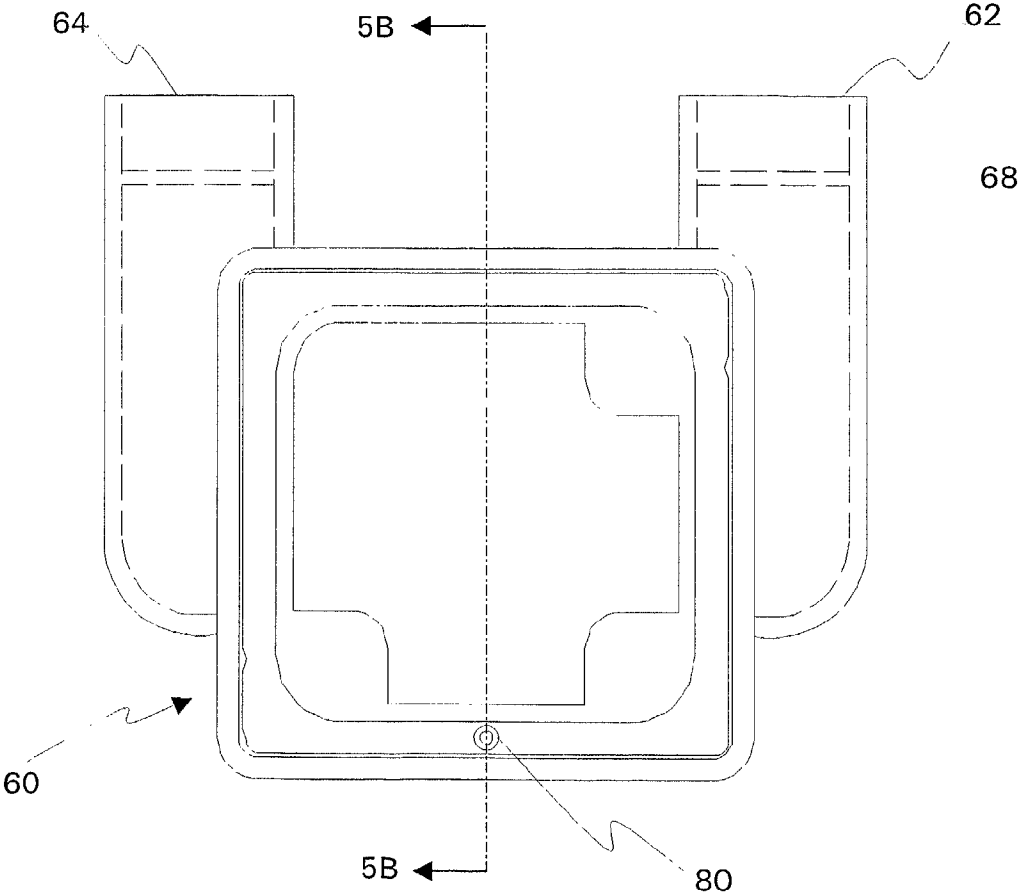

FIGS. 5A and 5B illustrate a different embodiment of the present invention in which a directional microphone 60 includes an internal connection between a front volume 66 and a back volume 68 that receives sound from a front inlet 62 and a back inlet 64, respectively. The front volume 66 and the back volume 68 are separated by a diaphragm 70 that is mounted within the housing by a support frame 72. An internal hollow tube 80 is mounted in the support frame 72. The hollow tube 80 has a length of generally between 1 mm to 6 mm and an opening with a diameter of about 0.05 mm to about 0.5 mm. In addition to this embodiment, the invention contemplates supporting the hollow tube 80 with other structures such that the tube 80 may pierce the diaphragm and possibly the backplate. Further, the tube 80 can be integrally formed in the inner wall of the housing.

In yet a further embodiment, it may be desirable to have two wind noise suppression tubes or channels in parallel. Thus, one wind noise suppression tube or channel may be located outside the housing and another inside. Or, in other embodiments, there could be two tubes or channels within the interior or two tubes or channels on the exterior of the housing. As used herein, tubes and channels are types of conduits.

Figure 6:
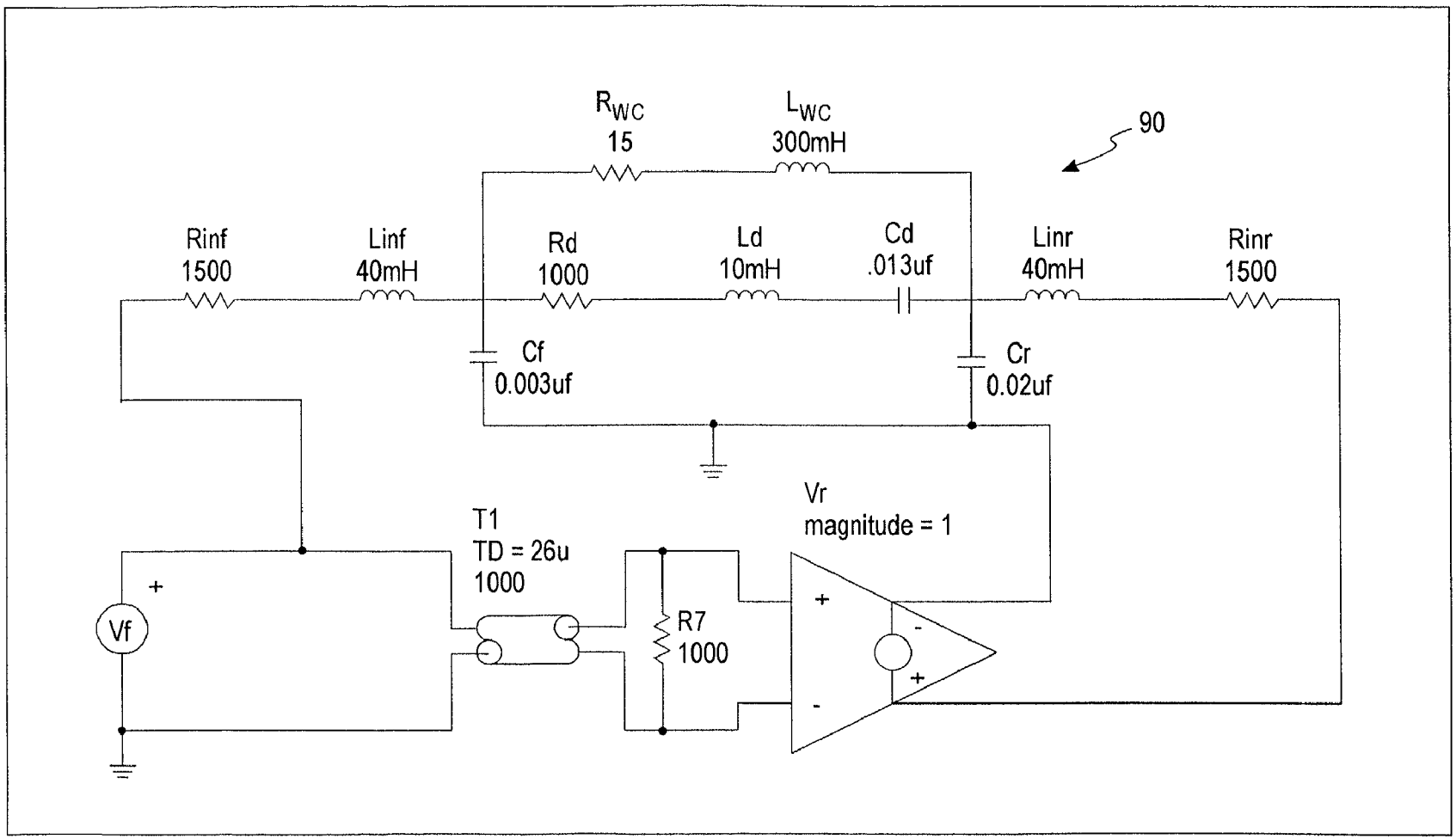
FIG. 6 is an exemplary electrical schematic analogizing the acoustical network of a directional microphone having an external or internal wind noise suppression tube/channel of the present invention.

FIG. 6 is an electrical schematic of an acoustical network 90 of a directional microphone of the present invention and is similar to the schematic of FIG. 2A. The only difference is that the highly resistive vent has been replaced by the elongated tube (or channel) of the present invention, which introduces a much larger inductive element in the circuit (i.e., the increased acoustical inertance from the tube/channel) and a much smaller resistive element due to its larger diameter. Hence, the circuit now includes $R_{wc}$ and $L_{wc}$, which are the resistance and inductance of a wind noise suppression channel/tube ("WC") that connects the front and back volumes of the directional microphone. The RL characteristics of the wind noise suppression channel/tube WC present, in essence, a high pass filter to the acoustical network 90.

Figure 7:
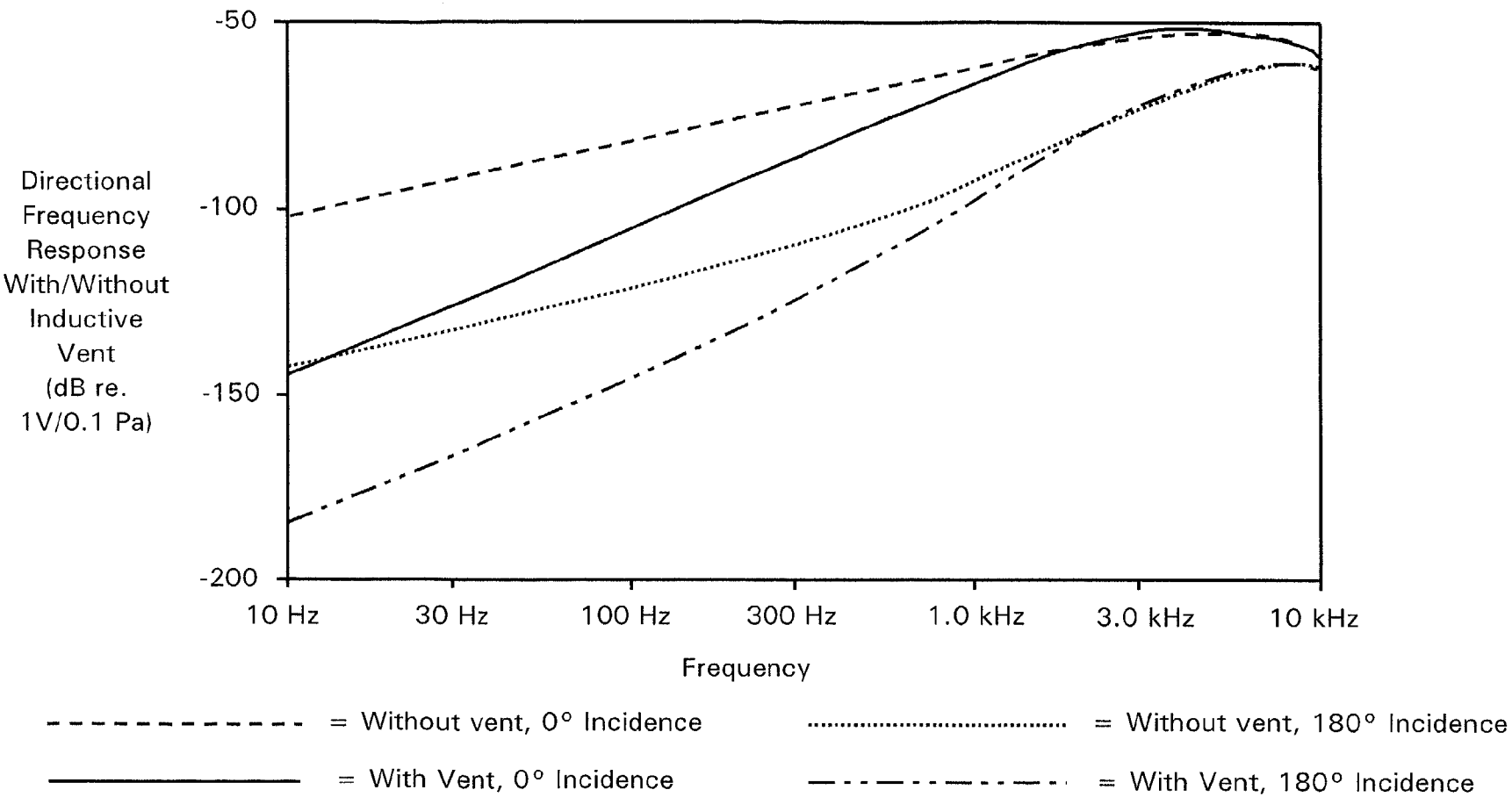
FIG. 7 is a frequency response curve that compares a standard directional microphone with a directional microphone that has an external or internal wind noise suppression tube of the present invention.

FIG. 7 illustrates the effects of a wind noise suppression channel/tube in the directional microphone at 0° and 180° angles of incidence of the sound wave. The inductive characteristics of a directional microphone according to the present invention brought about through the external channel 42 of FIG. 3C, the external tube 52 of FIG. 4C, or the internal tube 80 of FIG. 5B cause an increase in the slope of the curves, resulting in a 12 dB/octave roll-off at the low frequencies, instead of only the 6 dB/octave roll-off caused by the subtraction of time delayed signals (i.e., the principle of directivity in a directional microphone due to the screens). Because wind noise is mainly a low frequency noise source, a directional microphone according to the present invention acts to suppress (and preferably cancel) these wind noises such that only the more desirable sounds are heard by the wearer of the hearing aid.

A comparison of FIG. 2B with FIG. 7 yields two noteworthy observations. First, the curves for the no-vent model in FIG. 2B and the curve for the no-WC model in FIG. 7 are identical, as would be expected. Second, the higher inductance from the wind noise suppression channel/tube substantially affects the shape of the curve.

Figure 8A:
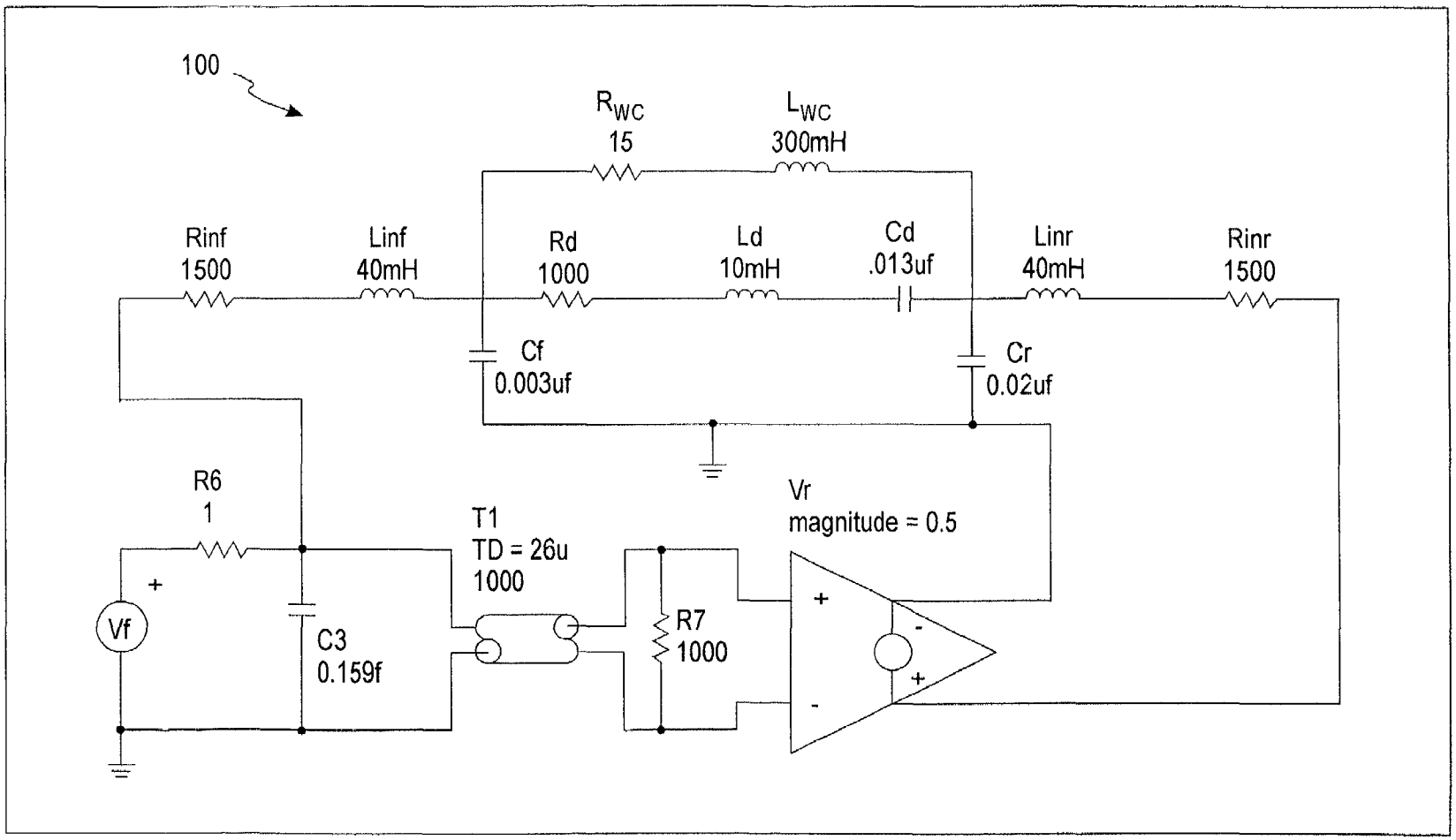
FIG. 8A is an exemplary electrical schematic analogizing the acoustical network of a directional microphone having an external or internal wind noise suppression tube with a wind noise as an input source.
Figure 8B:
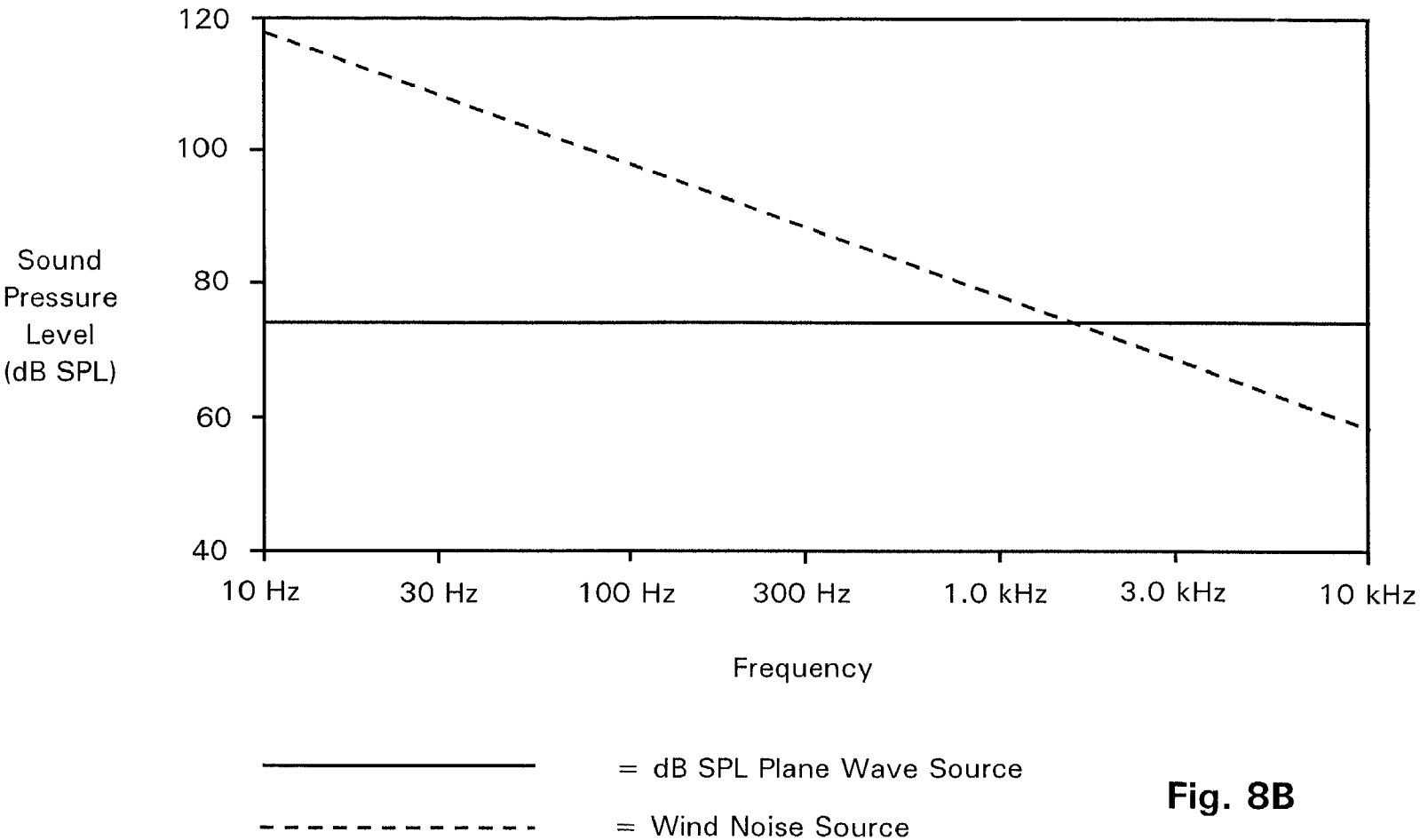
FIG. 8B is a graph of the sound pressure levels of the wind noise source of FIG. 8A and a 74 dB SPL plane wave that represents conversational speech.

FIG. 8A is an electrical schematics representation of an acoustical network 100 that models the effects of a wind noise acting on the system where the wind noise introduces a pressure imbalance between the front and rear inlets. The components $V_F$, $R_6$, $C_3$, $R_7$, and $V_R$ have been fixed to values that would approximate the pressure imbalance inputs of a certain wind noise that is shown in FIG. 8B. The magnitude of $V_R$ is chosen to be half the magnitude of $V_F$, which is provided by an assumption that one sound inlet of the microphone is midway between the origin of the wind turbulence and the second sound inlet. Thus, FIG. 6 models a sound input that has no pressure imbalance between the front and rear inlets, whereas FIG. 8A has introduced components that model a pressure imbalance associated with that sound input.

FIG. 8B represents the two types of sound inputs for the model of the directional microphone conditions illustrated in the acoustical network 90 in FIG. 6 or the acoustical network 100 in FIG. 8A. The horizontal Plane Wave Source at 74 dB SPL is representative of conversational speech. The Wind Noise Source has a high SPL at the low frequencies and has been selected based on a paper which suggests a level of 98 dB SPL at 100 Hz for a wind with a velocity of 10 miles/hour. This paper titled, "Electronic Removal Of Outdoor Microphone Wind Noise" by Shust et al., was presented at the 136th Meeting of the Acoustical Society of America, in October of 1998, and is incorporated herein by reference in its entirety.

Figure 8C:
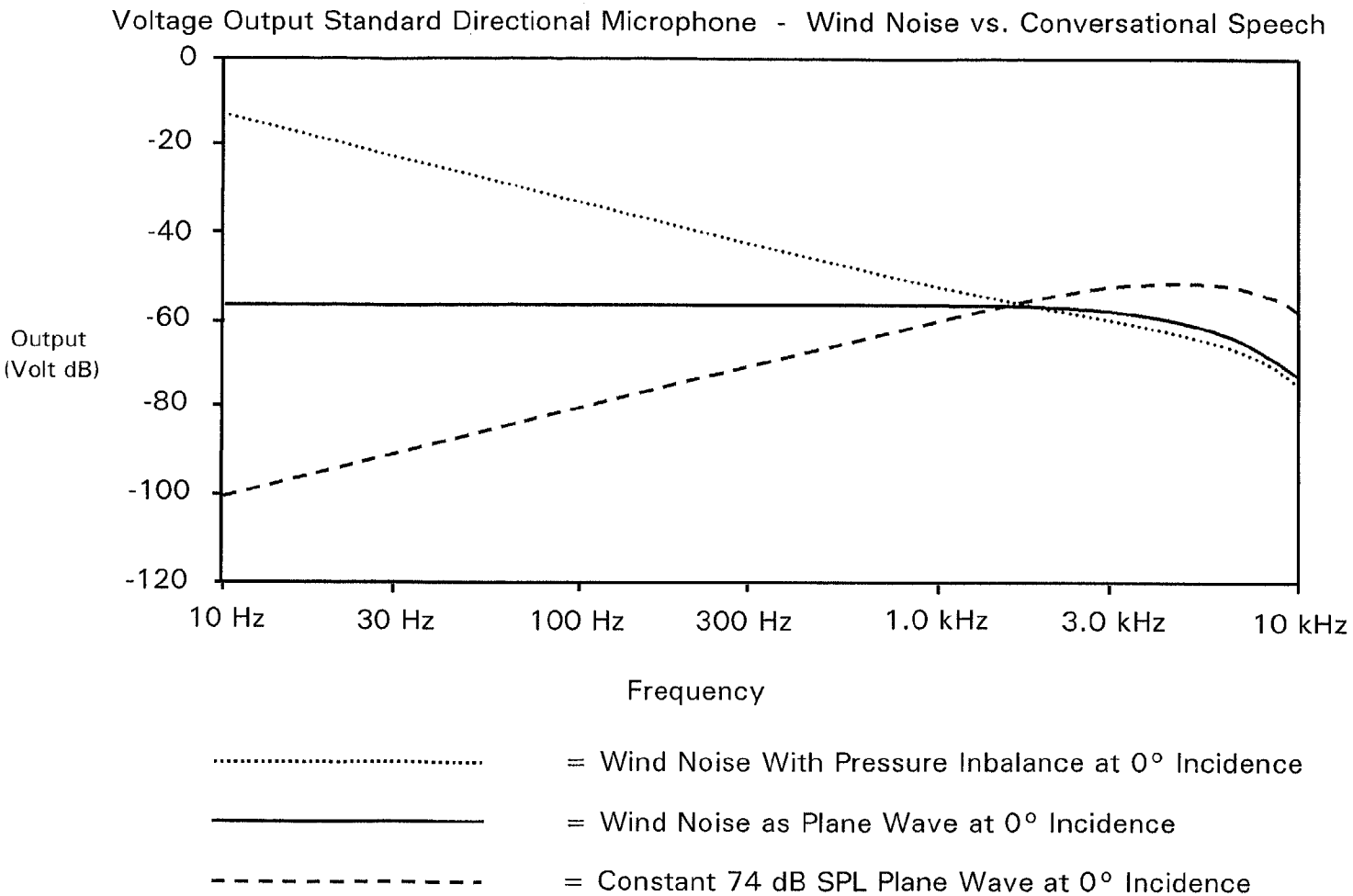
FIG. 8C illustrates the output of a standard directional microphone that lacks the wind noise suppression tube of the present invention.
Figure 8D:
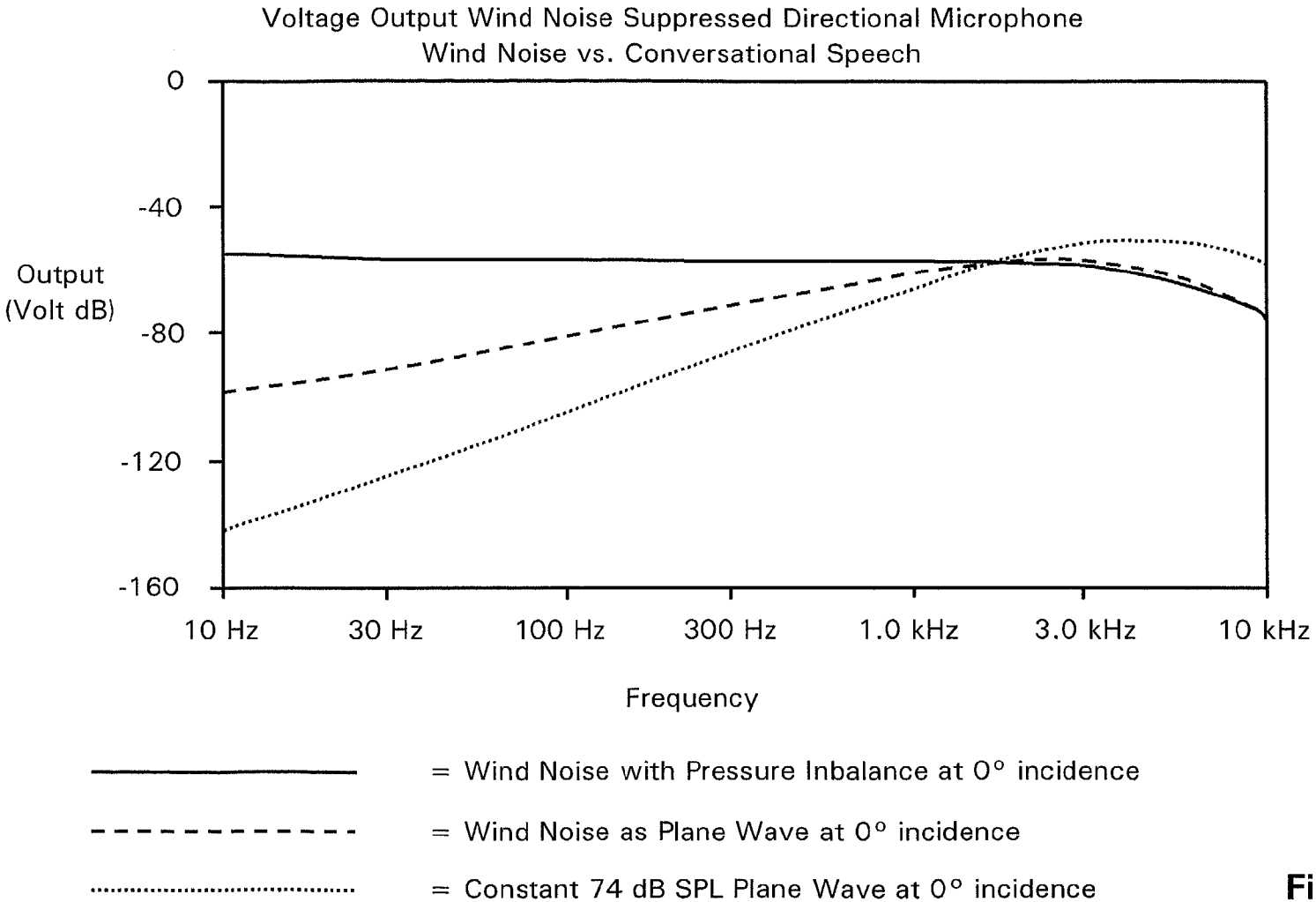
FIG. 8D illustrates the output of a directional microphone having an external or internal wind noise suppression tube of the present invention.

FIGS. 8C and 8D illustrate the voltage outputs of a standard directional microphone (i.e., one that lacks $R_{wc}$ and $L_{wc}$ shown in the acoustical networks 90 and 100) and a wind-noise suppressed directional microphone of the present invention, respectively, for the input sound sources of FIG. 8B. Three curves are shown in FIGS. 8C and 8D. Curve 1, identified as "Constant 74 dB SPL Plane Wave at 0° Incidence," is representative of constant Conversational Speech at 74 dB SPL. Curve 2, identified as "Wind Noise as Plane Wave at 0° Incidence," is representative of the Wind Noise as a Plane Wave with no pressure imbalance (i.e., the Wind Noise Source of FIG. 8B inputted into the acoustical network 90 of FIG. 6 where $V_r=V_f$). Curve 3, identified as "Wind Noise With Pressure Imbalance at 0° Incidence," is representative of the Wind Noise with a pressure imbalance (i.e., the Wind Noise Source of FIG. 8B inputted into the acoustical network 100 of FIG. 8A where $V_r=0.5V_f$). Curve 3 is the most complete model for wind noise. Note that the curves do not represent frequency responses but, instead, output responses of a directional microphone as the source sound characteristics are being inputted into the directional microphone.

The difference between Curves 1 and 3 in both FIGS. 8C and 8D remains unchanged, meaning that the directional microphone's output from a wind noise source with a pressure imbalance (Curve 3 in both FIGS. 8C and 8D) relative to that of conversational speech source (Curve 1 in both FIGS. 8C and 8D) is the same for a standard directional microphone as well as the directional microphone having the wind noise suppression feature according to the present invention. A difference between a wind noise suppressed and a standard directional microphone is the 12 dB/octave roll-off instead of a 6 dB/octave roll-off. Consequently, there is much less tendency for the microphone elements to overload because of the high output at low frequencies that is characteristic of wind noise.

Further, there is also much less likelihood for low frequency masking by the wind noise of the higher frequencies of the speech signal. Notice that Curve 1 (conversational speech) in FIG. 8D exceeds the maximum level produced by wind noise. Accordingly, the masking effect of wind noise is not as prominent. Consequently, it is easier to hear the speech signal in the presence of a wind noise source when the present invention is employed on directional microphones.

There is another useful benefit derived from the directional microphone of the present invention. Wearers of directional hearing aids (i.e., those that have directional microphones) often found that the high frequency boost afforded by the microphone was an advantage. As a result, pressure microphones were designed with a 6 dB/octave roll-off at low frequencies. These pressure microphones were also found to be beneficial so they were modified with a 12 dB/octave roll-off to increase the effect even more. Consequently, a directional microphone with a high frequency boost appeared to be beneficial for speech understanding in certain situations.

Figure 9:
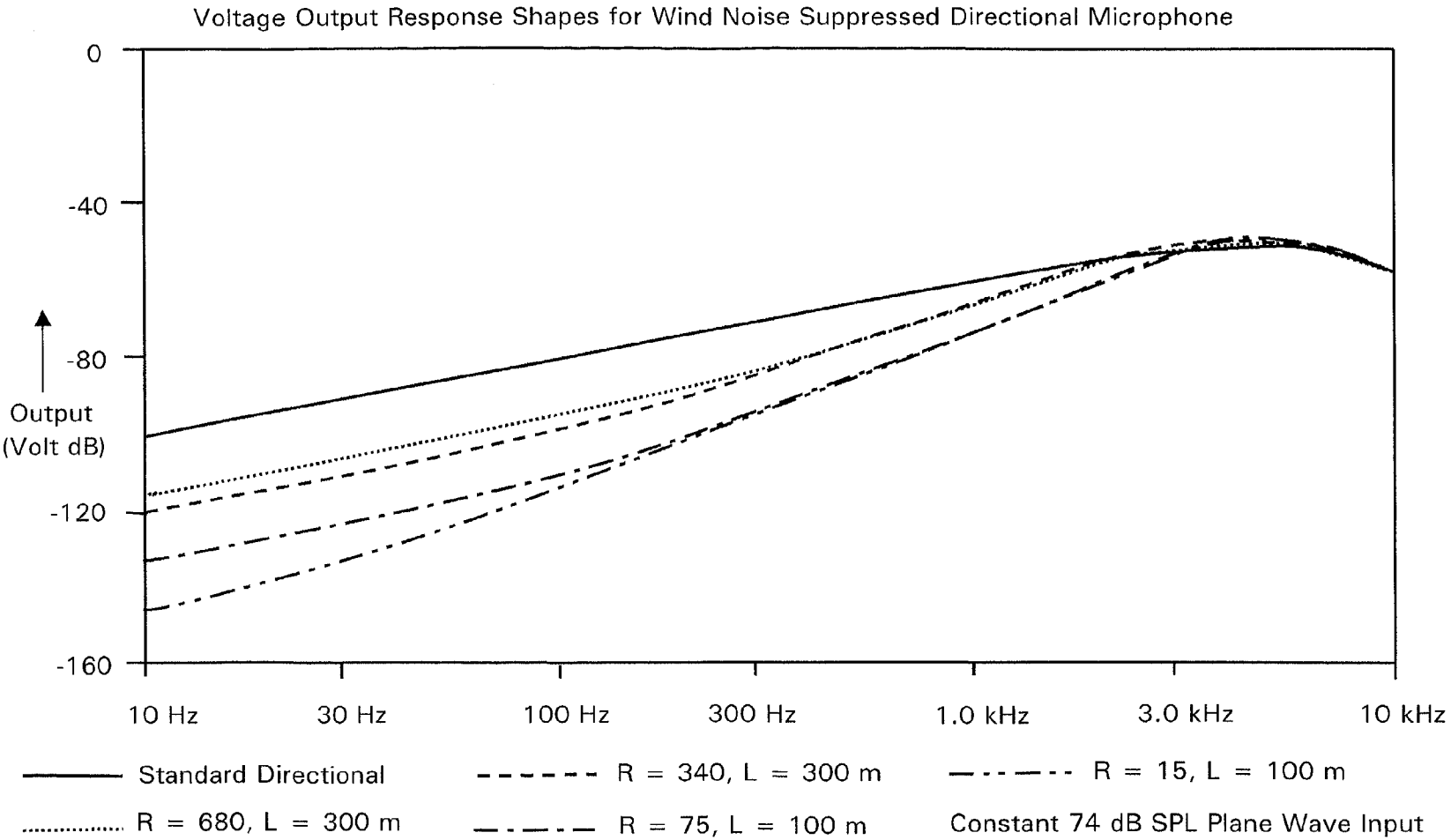
FIG. 9 illustrates the response shapes of various geometries of the wind noise suppression tube/channel by listing the acoustical resistance "R" and the inertance "L" of the tube.

FIG. 9 illustrates that different values of the acoustical resistance and inertance of wind noise suppression channels/tubes can result in different frequency response shapes. Here, the input is simply a 74 dB SPL plane wave input. A standard directional microphone that lacks wind noise suppression channels/tubes is also illustrated for the sake of comparison. Accordingly, diameters and lengths of the wind noise suppression channels/tubes can be selected to achieve a particular output response. Further, the internal surface structure of the wind noise suppression channels/tubes (e.g., a roughened surface to create more resistance or a more elliptical or bubbled shape having a varying cross-sectional area along the length of the wind noise suppression channels/tubes) can be altered to achieve desirable $R_{wc}$ and $L_{wc}$ values. For example, a tube having a length of 5 mm and a diameter of 0.58 mm has an inductance of 300 mH CGS and a resistance of 340 Ohms CGS. A tube with half the length (i.e., 2.5 mm) and a diameter of 0.4 mm has an inductance of 100 mH CGS and a resistance of 680 Ohms CGS. In any case, as compared to a standard directional microphone, the directional microphone according to the present invention preferably has lower sensitivity (i.e., a larger roll-off) for frequencies below about 500 Hz and, even more preferably, for frequencies below about 2.0 kHz.

Figure 10:
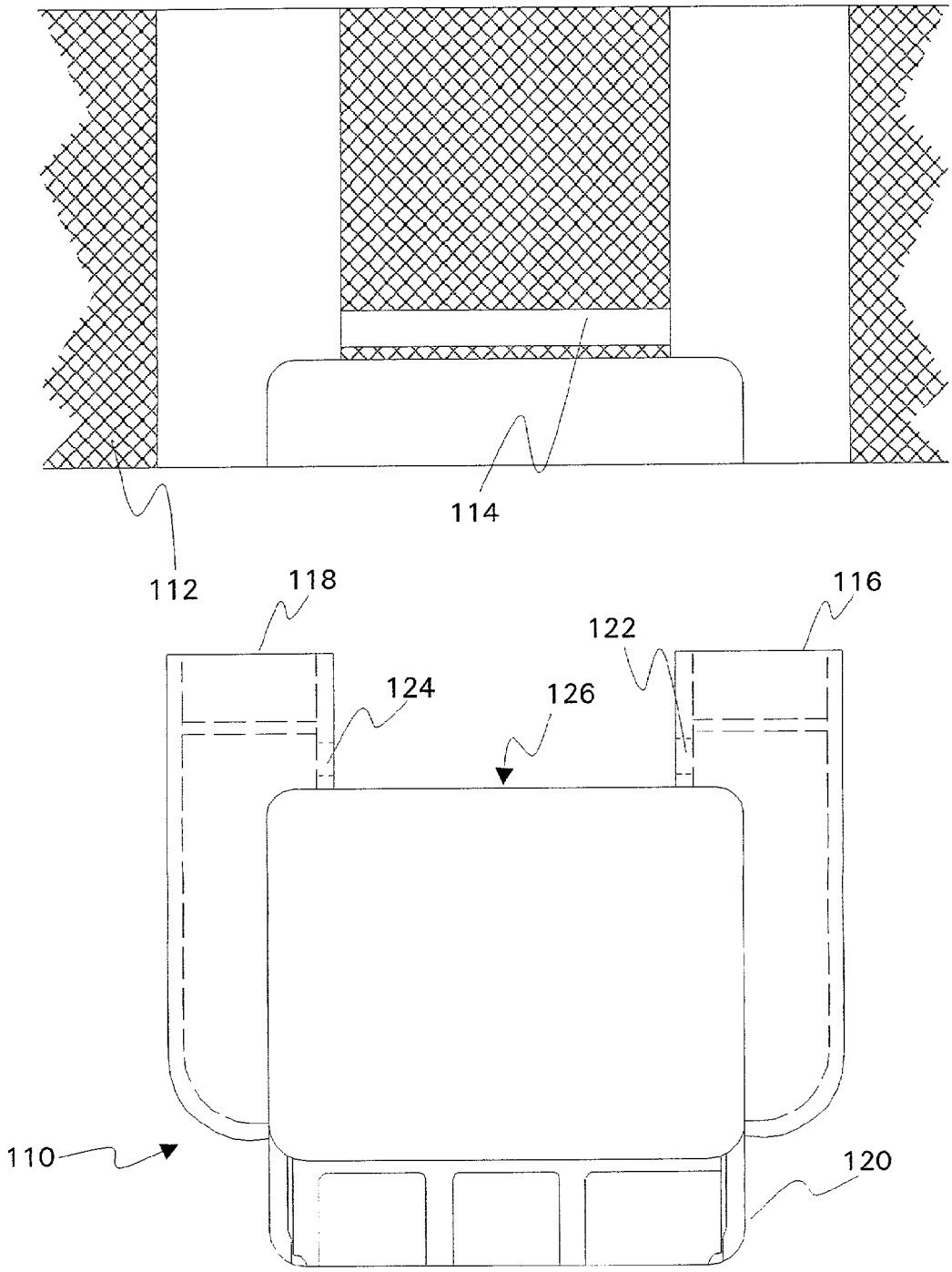
FIG. 10 illustrates a listening device which includes a mounting plate molded to form a wind noise suppression conduit and a directional microphone.

FIG. 10 illustrates a directional microphone 110 and a cutaway surface view of a faceplate or mounting plate 112 which includes a wind noise suppression conduit 114. The microphone 110 includes a front inlet 116, a back inlet 118, and a housing 120. When the housing 120 and the mounting plate 112 are positioned against each other, the front inlet 116 is connected to the back inlet 118 via the conduit 114. The shape and geometry of the conduit 114 is selected according to one or more of the parameters set forth above in order to achieve desired resistance and inductance values, $R_{wc}$ and $L_{wc}$, respectively. For example, in alternate embodiments, the cross sectional shape of the conduit 114 may be circular or elliptical, C-shaped, or rectangular, and the shape may be constant or varied along the length of the conduit 114. The internal surface structure of the conduit 114 may be smooth or varied to create more resistance, for example. In the illustrated embodiment shown in FIG. 10, the conduit 114 is a hollow tube that connects the front inlet 116 and the back inlet 118 via the front conduit opening 122 and back conduit opening 124.

In another embodiment, the conduit 114 is a channel or groove formed on the surface of the mounting plate 112, and is closed by positioning a bottom surface of the microphone 110 over the conduit 114. In yet another embodiment, the conduit 114 is formed in the mounting plate 112 such that one of the surfaces of the conduit 114 is defined by an outer surface 126 of the microphone 110. In still another embodiment, the microphone 110 does not include openings 122, 124, and the conduit 114 is positioned in the mounting plate 112 ahead of the front inlet 116 and back inlet 118.

The directional microphone of the present invention is useful for all listening devices, including hearing aids. The audio signals from the directional microphone according to the present invention can be amplified by an amplifier and, subsequently, sent to a receiver that broadcasts an amplified acoustical signal to the user of the listening device.

While the present invention has been described with reference to one or more particular embodiments, those skilled in the art will recognize that many changes may be made thereto without departing from the spirit and scope of the present invention. Each of these embodiments and obvious variations thereof is contemplated as falling within the spirit and scope of the claimed invention, which is set forth in the following claims.

What is claimed is:

1. A directional microphone, comprising:

a housing;

a diaphragm dividing said housing into a front volume and a back volume;

electronics for detecting signals corresponding to movements of said diaphragm;

a front inlet to said front volume;

a back inlet to said back volume; and an elongated acoustical conduit connecting said front volume and said back volume, said acoustical conduit having an acoustical inertance that provides an additional 6 dB/octave low frequency roll-off in addition to the 6 dB/octave low frequency roll-off in said directional microphone without said elongated acoustical conduit.

2. The directional microphone of claim 1, wherein said acoustical conduit is positioned within said diaphragm.

3. The directional microphone of claim 1, wherein said diaphragm has a support structure holding said diaphragm in said housing, said acoustical conduit being positioned within said support structure.

4. The directional microphone of claim 1, wherein said acoustical conduit has acoustical characteristics that are predominantly inductive, rather than resistive.

5. The directional microphone of claim 1, wherein said front and back inlets include inlet tubes.

6. The directional microphone of claim 5, wherein said inlet tubes include a screen structure.

7. The directional microphone of claim 1, wherein said acoustical conduit has a length of from about 1 mm to about 6 mm.

8. The directional microphone of claim 1, wherein said acoustical conduit is positioned external to said housing.

9. The directional microphone of claim 1, wherein said acoustical conduit has a diameter of from about 0.05 mm to about 0.5 mm.

10. The directional microphone of claim 1, wherein said directional microphone has a frequency response curve with a 12 dB/octave roll-off at frequencies below about 2.0 kHz.

11. The directional microphone of claim 1, wherein said acoustical conduit presents an acoustical inductance of at least 100 mH.

12. The directional microphone of claim 1, wherein said acoustical conduit is a cylindrical tube.

13. The directional microphone of claim 12, wherein said cylindrical tube is integrally formed within walls of said housing.

14. A directional microphone, comprising:

a moveable structure producing signals responsive to sound energy and dividing a front volume from a back volume, said front volume and said back volume being exposed to the environment for receiving said sound energy; and a wind noise suppression conduit acoustically connecting said front volume and said back volume, said wind noise suppression conduit having an acoustical mass that causes said directional microphone to have a frequency response curve with 12 dB/octave low frequency roll-off at frequencies below about 500 Hz.

15. The directional microphone of claim 14, wherein said wind noise suppression conduit is located external to a housing in which said moveable structure is disposed.

16. The directional microphone of claim 14, wherein said wind noise suppression conduit is located within a housing in which said moveable structure is disposed.

17. The directional microphone of claim 14, wherein said wind noise suppression conduit is formed by a housing in which said moveable structure is disposed and a mounting plate positioned against said housing.

18. The directional microphone of claim 14 wherein said directional microphone has a frequency response curve with a 12 dB/octave low frequency roll-off at frequencies below about 2.0 kHz.

19. The directional microphone of claim 14, wherein said wind noise suppression conduit has a length of from about 1 mm to about 6 mm.

20. The directional microphone of claim 19, wherein said wind noise suppression conduit has a diameter of from about 0.05 mm to about 0.5 mm.

21. The directional microphone of claim 14, wherein said wind noise suppression conduit has a diameter of from about 0.05 mm to about 0.5 mm.

22. The directional microphone of claim 14, wherein said wind noise suppression conduit is formed by a housing of said directional microphone and a mounting plate positioned against said housing and connects sound inlets leading to said front and back volumes.

23. The directional microphone of claim 14, wherein said wind noise suppression conduit is located external to a housing of said directional microphone and connects sound inlets leading to said front and back volumes.

24. The directional microphone of claim 14, wherein said wind noise suppression conduit has a circular internal opening.

25. The directional microphone of claim 14, wherein said wind noise suppression conduit has a rectangular opening.

26. The directional microphone of claim 14, wherein said wind noise suppression conduit is formed at least in part by walls of said housing.

27. The directional microphone of claim 26, wherein said wind noise suppression conduit is formed entirely by said walls of said housing.

28. The directional microphone of claim 14, wherein said wind noise suppression conduit is located internal to a housing of said directional microphone and extends between said front and back volumes.

29. The directional microphone of claim 28, wherein said wind noise suppression conduit is integrally formed within the walls of said housing of said directional microphone.

30. The directional microphone of claim 28, wherein said wind noise suppression conduit is a tubular structure that extends through a support frame supporting said moveable structure.

31. The directional microphone of claim 14, wherein said wind noise suppression conduit presents an acoustical inductance of at least 100 mH.

32. A method of suppressing wind noise in a directional microphone having a front and back volume, comprising:

acoustically connecting said front volume and said back volume with an elongated conduit having an acoustical inertance that provides an additional 6 dB/octave low frequency roll-off in addition to the 6 dB/octave low frequency roll-off in said directional microphone without said elongated conduit.

33. The method of claim 32, wherein said connecting occurs between a front inlet tube leading into said front volume and a back inlet tube leading into said back volume.

34. The method of claim 33, wherein said front inlet tube and said back inlet tube includes a screen structure, and elongated conduit being connected to said front and back inlet tubes downstream of said screen structures.

35. The method of claim 32, wherein said connecting occurs internally within said microphone across a diaphragm dividing said front volume and said back volume.

36. The method of claim 32, wherein said elongated conduit has a length of from about 1 mm to about 6 mm.

37. The method of claim 32, wherein said elongated conduit has a diameter of from about 0.05 mm to about 0.5 mm.

38. The method of claim 32, wherein said acoustical inertance provides said directional microphone with a frequency response curve with a 12 dB/octave low frequency roll-off at frequencies below about 2.0 kHz.

39. The method of claim 32, wherein said acoustical inertance presents an acoustical inductance of at least 100 mH.

40. A method of preventing a low frequency overload due to wind noise in a directional microphone having a front volume and a back volume separated by a diaphragm, comprising:

adding an acoustical inductive element in parallel with said diaphragm, wherein the adding includes connecting said front volume and said back volume with an elongated acoustical conduit, said elongated acoustical conduit having an acoustical mass that causes said directional microphone to have a frequency response curve with a 12 dB/octave low frequency roll-off at frequencies below about 500 Hz.

41. The method of claim 40, wherein said adding includes connecting inlets to said front volume and said back volume at a location external to a housing of said directional microphone.

42. The method of claim 40, wherein said adding includes connecting said front volume and said back volume at a location internal to a housing of said directional microphone.

43. A directional microphone, comprising:

a moveable structure producing signals responsive to sound energy and dividing a front volume from a back volume, said front volume and said back volume being exposed to the environment for receiving said sound energy; and a wind noise suppression conduit acoustically connecting said front volume and said back volume, the wind noise suppression conduit having a diameter of from about 0.05 mm to about 0.5 mm.

44. The directional microphone of claim 43, wherein said directional microphone has a frequency response curve with a 12 dB/octave low frequency roll-off at frequencies below about 2.0 kHz.

45. A method of suppressing wind noise in a directional microphone having a front and back volume, comprising acoustically connecting said front volume and said back volume with an elongated conduit having an acoustical inertance, wherein said connecting occurs between a front inlet tube leading into said front volume and a back inlet tube leading into said back volume, and wherein said front inlet tube and said back inlet tube includes a screen structure, said elongated conduit being connected to said front and back inlet tubes downstream of said screen structures.

46. The method of claim 45, wherein said acoustical inertance provides an additional 6 dB/octave low frequency roll-off in addition to the 6 dB/octave low frequency roll-off in said directional microphone.

47. The directional microphone of claim 5, wherein said elongated acoustical conduit is generally perpendicular to said front inlet tube and said back inlet tube.

* * * * *